United States Patent [19]

Chesnut

[11] Patent Number: 4,641,574

[45] Date of Patent: Feb. 10, 1987

[54] POWER SCREW PROTECTOR FOR REFUSE COMPACTOR

[75] Inventor: Paul B. Chesnut, Center Township, Vanderburgh County, Ind.

[73] Assignee: Whirlpool Corporation, Benton Harbor, Mich.

[21] Appl. No.: 804,463

[22] Filed: Dec. 4, 1985

[51] Int. Cl.[4] ..... B30B 1/18

[52] U.S. Cl. ..... 100/229 A; 100/290

[58] Field of Search ..... 100/229 A, 289, 290; 184/5

[56] References Cited

U.S. PATENT DOCUMENTS

| | | | |
|---|---|---|---|
| 859,637 | 7/1907 | Adams | 100/290 X |
| 2,484,731 | 10/1949 | Pritchett . | |
| 3,786,744 | 1/1974 | Miller | 100/229 A |
| 3,800,694 | 4/1974 | Miller | 100/229 A X |
| 3,817,352 | 6/1974 | Bourgeois | 100/229 A X |
| 3,831,513 | 8/1974 | Tashman | 100/289 X |
| 3,921,515 | 11/1975 | Eckerle | 100/229 A |
| 4,241,652 | 12/1980 | Smedlund . | |
| 4,387,635 | 6/1983 | Abbestam | 100/290 X |

FOREIGN PATENT DOCUMENTS

| | | | |
|---|---|---|---|
| 2394389 | 2/1979 | France | 100/290 |

*Primary Examiner*—Billy J. Wilhite

*Attorney, Agent, or Firm*—Lowe Price LeBlanc Becker & Shur

[57] ABSTRACT

An upper portion of each power screw of a refuse compactor is covered by a protective sleeve to insulate the threads of the screw from refuse. The upper end of the sleeve is loosely retained to the ram to move longitudinally with the ram while yielding to any pivoting of the ram during its downstroke under load. The protective sleeve additionally tends to distribute lubrication along the threads of the power screw during cycling of the ram. A protective skirt mounted to the frame of the compactor insulates a lower portion of the power screw from refuse.

22 Claims, 10 Drawing Figures

Fig. 1
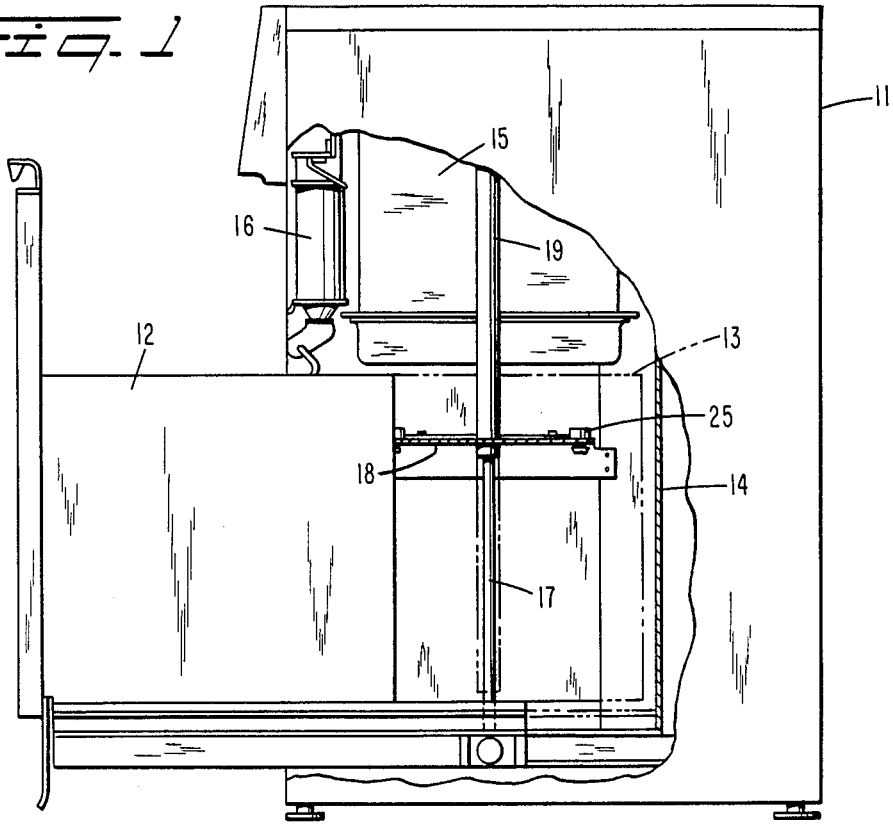
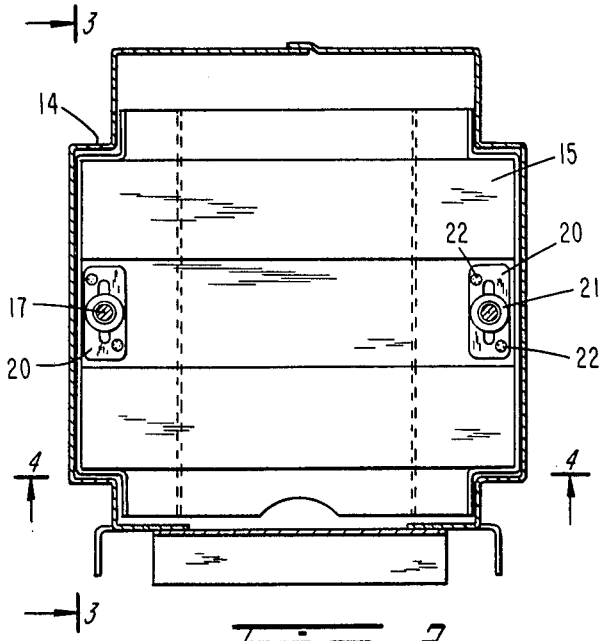
Fig. 2

POWER SCREW PROTECTOR FOR REFUSE COMPACTOR

TECHNICAL FIELD

The invention relates generally to refuse compactors, and more particularly, toward apparatus for protecting the power screw threads of compactors from contamination by refuse.

BACKGROUND OF THE INVENTION

Conventional refuse or trash compactors, as found in well-equipped kitchens, generally consist of an esthetically pleasing cabinet around a rigid frame designed to allow a power-driven ram to crush and compact refuse contained in a plastic bag supported in a removeable drawer. A convenient and sturdy drive for the ram comprises an electric motor driving one or more threaded power screws which generate controlled downward refuse-compacting forces when turned one way and then reverse direction to lift the ram to permit the drawer to be removed or additional refuse to be deposited within the drawer.

One example of a trash compactor utilizing a single threaded screw to drive the ram is disclosed in U.S. Pat. No. 3,817,352, titled "Lubricating Means for Trash Compactor Ram", in which a single power screw is completely enclosed within a moveable ram and is therefore inherently protected from contact with contaminants such as bits of refuse, especially strings and strips of material that could otherwise become entangled with the screw and hinder its proper operation.

U.S. Pat. No. 3,786,744, titled "Refuse Compactor Support Structure", to Miller et al. and U.S. Pat. No. 3,800,694, titled "Means for Mounting Components of a Refuse Compactor in Coordinated Relationship", to Miller et al, both of which are owned by the assignee hereof, disclose details, respectively, of a suitable frame structure and a typical two power screw driven ram type trash compactor. Specifically, this type of trash compactor has two long power screws vertically aligned, one inside each side of the cabinet, in a manner that permits a single pinion and chain drive to cause both screws to turn simultaneously in the same direction to provide, via threaded-on power nuts at the ram, two essentially parallel forces on the ram either in an upward direction or, by reversal of the drive motor direction, in the opposite direction. The ram is normally maintained in its uppermost position so that refuse may be deposited into a refuse bag contained in the removeable drawer position underneath.

Periodically, the user operates a switch that causes the ram to be driven down by the power screws so that it crushes the trash contained within the refuse bag in the drawer below. If there is insufficient trash the ram is stopped by a cross rail and a load responsive motor switch operates to reverse the direction of rotation of the power screws so that the ram automatically returns to its uppermost position. However, as more and more refuse is compacted within the drawer the ram travels downward by correspondingly smaller distances, until there is sufficient compacted refuse to permit removal of the bag. During each actuation of the ram by a user, following deposit of additional refuse to be compacted, the drive motor rotation is reversed by the load responsive switch when a predetermined degree of compaction is achieved. It is generally during this phase of the operation of the apparatus that assorted elements of the refuse, particularly bits of string, strips of paper and plastic, and the like, have a tendency to hang over the drawer edge and may occasionally become entangled with the threads of the power screws on either side. As glass bottles, cans and bottle caps are compacted, small, sharp, hard or abrasive bits of dirt may contact the screw thread and adhere to it, eventually causing accelerated wear. Also, particularly on dry days, small pieces of paper and plastic from the refuse may tend to become electrostatically attracted to the grease on the power screws and may tend to drift over from the drawer and come into contact with the lubricated greasy power screw threads.

The net result of incidental encounters between elements of the refuse and the power screw threads that are exposed on either side of the drawer, as the refuse is being compacted, is an accumulation of undesirable dirt on the power screws that eventually interferes with silent well-lubricated coaction between the power screws and power nuts carried at the top part of the ram to obtain the desired motion. This is aggravated by a tendency for the lubrication to drift downward on the screws over time and accumulate on a portion of each screw below the bottom of the stroke of the ram. It is generally very difficult and inconvenient for the owner of such a trash compactor to reach in and clean the threads and relubricate them frequently enough for proper operation of the compactor over prolonged periods.

There is, therefore, a current need for apparatus that will insulate power threads in power-driven trash compactors from dirt and refuse and insure well-lubricated, silent and longlasting operation thereof.

DISCLOSURE OF THE INVENTION

Accordingly, it is an object of this invention to provide apparatus for insulating trash compactor power screws from contact with dirt and refuse.

It is a further object of this invention to provide apparatus that serves to retain lubricatant around the threads of trash compactor power screws while protecting them from contact with dirt and refuse.

Yet another object of this invention is to provide apparatus that protects the power screws of trash compactors from dirt and refuse, while accommodating for some unevenness in the motion of the screw driven ram during the compaction of hard or oddly shaped objects in the compactor.

It is an even further object of this invention to provide, in a power driven refuse compactor, power screws which are insulated from dirt and refuse over their entire lengths during all phases of operation of the compactor.

These and other benefits of this invention are achieved by providing in a refuse compactor comprising a frame, a refuse compaction drawer within the frame, a ram driven by at least one threaded power screw within the frame for externally supporting the ram in an upper position clear of the drawer and a lower position within the drawer to compact refuse therein and drive means for reciprocating the ram between these two positions, a protective, generally tubular, cover or sleeve surrounding the power screw with the cover pivotably retained to and moving with the ram while extending at least to the drawer top when the ram is in its upper most position. In accordance with another aspect of this invention, that portion of the power screw which is below the lowest end of the protective sleeve when the ram is in its uppermost position is protected from dirt and refuse by a cooperating protective skirt mounted to the frame of the compactor and extending below the protective sleeve when the ram is in its uppermost position.

BRIEF DESCRIPTION OF THE DRAWINGS

FIG. 1 is a partial sectional side view of a compactor showing one of the power screws with the ram in its uppermost position and the compactor drawer partially pulled out.

FIG. 2 is a plan view of the top of the compactor ram within the compactor frame.

BEST MODE FOR PRACTICING THE INVENTION

Figure 3:
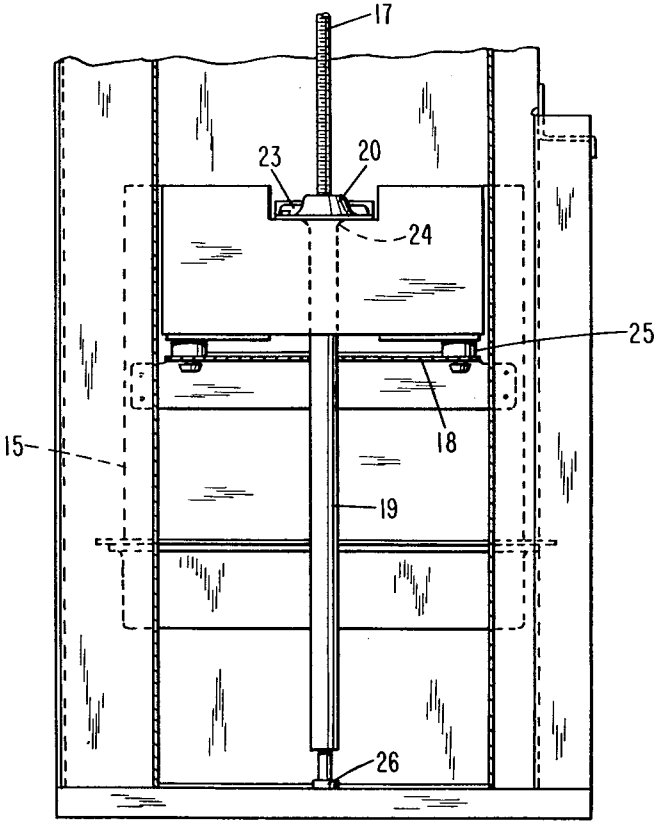
FIG. 3 is a side elevation view showing the ram in its lowest position, with the protective sleeve of this invention in place about a power screw.

A refuse compactor of the type in which the ram is driven by two power screws is shown in partial section in a vertical elevation view in FIG. 1. The compactor cabinet 11 contains within it a frame 14 which supports a slidingly removeable refuse containment drawer 12 which, when fully inserted into the compactor, will occupy position 13 (as shown in phantom lines) so as to be directly beneath ram 15. An optional deodorant spray element 16 is included in a corner of cabinet 11 and may be actuated either by the user or automatically upon complete withdrawal of the trash compaction drawer to remove the compacted trash therefrom.

Figure 4:
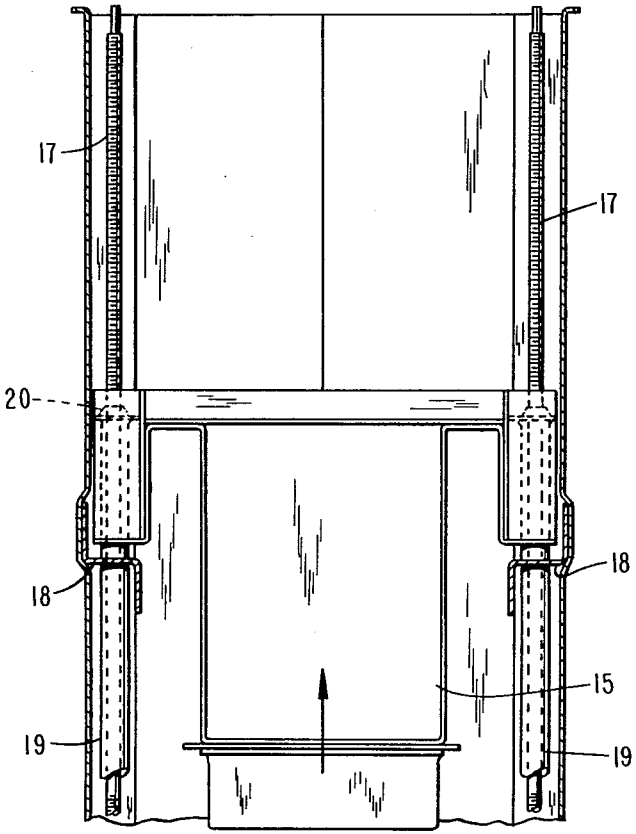
FIG. 4 is a front elevation view showing the ram of the compactor close to its lowest position, with the protective sleeves of this invention in place about the two power screws of the compactor.
Figure 8:
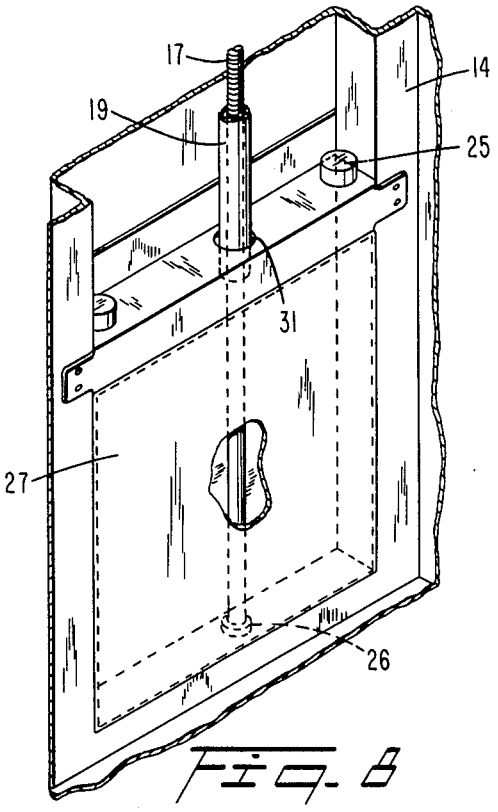
FIG. 8 is a perspective view of a compactor in which, in accordance with the invention, the lowest portion of a power screw is insulated from dirt and refuse over its entire length by a protective skirt.

Power screw 17 is shown with a protective sleeve 19 surrounding the upper portion thereof. The lower end of power screw 17 is supported by a portion of frame 14 by means of a journal bearing 26, as best seen in FIG. 3. Aperture 31 in cross rail 18, as best seen in FIG. 8, is somewhat larger than the exterior of protective sleeve 19 and permits easy movement thereof as ram 15 moves up and down. Ram 15 is shown in FIG. 1 at its uppermost position where its bottom completely clears the top of drawer 12. In a compactor of the type shown in FIG. 1 there is an identical second power screw on the other side of the compactor, as is best seen in FIG. 4.

Figure 6:
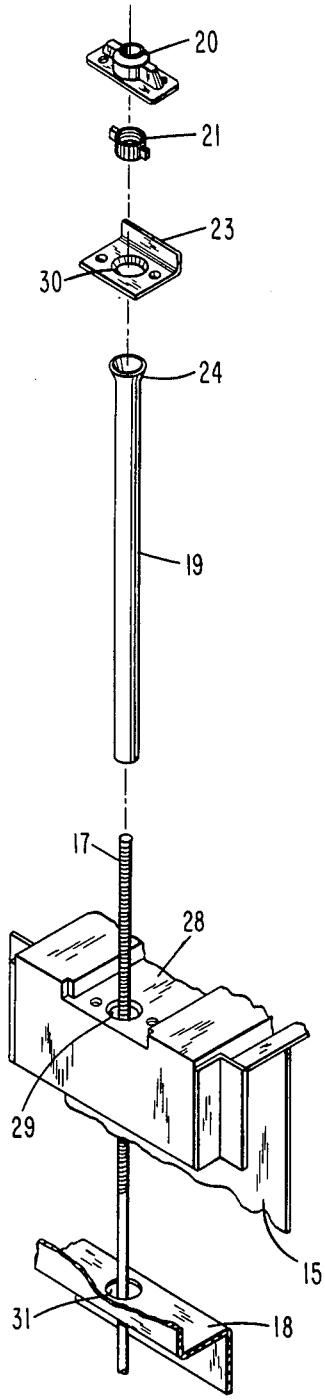
FIG. 6 is an exploded view of one embodiment of this invention showing the relative juxtaposition of a power screw, a protective sleeve of this invention and elements to retain the sleeve to the ram.

FIG. 2 is a plan view showing the top of ram 15 as it is supportd within frame 14 shaped to guide it slidingly at its corners in its vertical motion. Persons skilled in the art will appreciate that power screws 17 are aligned so as to be symmetriclly located with respect to the compactor ram 15, to ensure even application of force to the refuse being crushed there below. Power screws 17 come through the sides of compactor ram 15 and each power screw 17 has threaded thereon a power nut 21 prevented from rotating by retainer nut 20, as best seen in FIG. 6, which is firmly affixed to the top of ram 15 by screws 22. A doubler plate 23 enhancing the rigidity of the ram 15 is positioned below power nut 21 so that it rests beneath retainer nut 20 on the top portion 28 of the ram, again as best seen in FIG. 6.

When the ram 15 is in its lowermost position, as shown in FIG. 3, the lower surface thereof rests on the top of two preferably resilient stops 25 attached to and supported on side bar 18. When the ram is in this position protective sleeve 19 has its lower end just above journal bearing 26. FIG. 4 shows this particular juxtaposition of the ram at its lowest position within the compactor in a side view showing how both power screws engage the ram 15, one on either side.

Figure 7A:
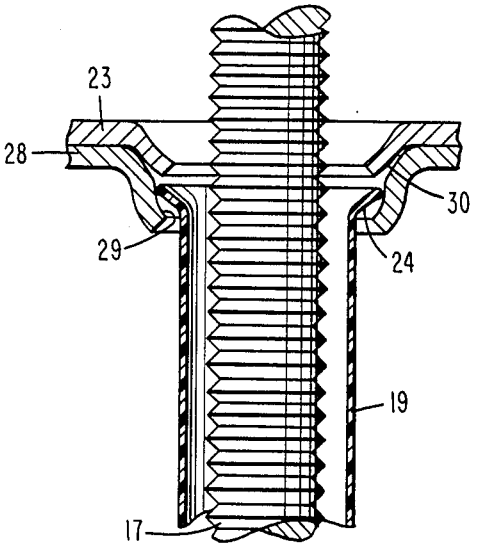
FIGS. 7A and 7B show how a protective sleeve of this invention, in one of its embodiments, is supported loosely about its flared top in a generally symmetric and a slightly pivoted position, respectively.
Figure 7B:
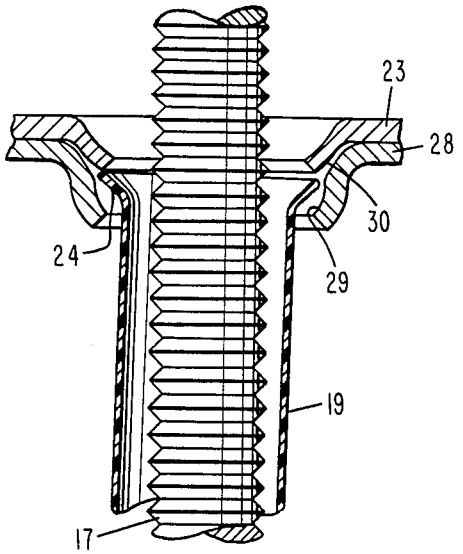

FIG. 6 shows clearly how a protective sleeve 19, as taught in this invention, may be positioned in the preferred embodiment. The top surface 28 of ram 15 is provided for each power screw with a shaped extruded spherically radiused aperture 29 having an internal diameter somewhat smaller than the flared end 24 of protective sleeve 19, as is best seen in FIGS. 7A and 7B. Therefore, as indicated in FIG. 6, when protective sleeve is dropped about power screw 17 the lower end of sleeve 19 will pass through aperture 31 of side bar 18 while its upper flared end 24 will be retained loosely inside shaped aperture 29 at the top surface 28 of ram 15. In this embodiment, a doubler plate 23 is also provided with a shaped spherically radiused extruded aperture 30 having an inside diameter comparable to that of shaped aperture 29 and therefore smaller in size than the outside diameter of flared portion 24 of protective sleeve 19. By "spherical radius" is meant the radius of a sphere that will fit the shape of the extruded aperture. As shown in FIG. 7A, when doubler plate 23 is placed above protective sleeve 19 supported by shaped aperture 29 the flared top 24 of sleeve 19 is free to move about by a small amount, either vertically or by tilting, within the annular space defined by the differing extrusion spherical radii of apertures 29 and 30, as is indicated in FIG. 7B. Reference to FIG. 6 shows how power nut 21 may then be threaded onto power screw 17 and nonrotatably held in place by retainer nut 20 affixed by means of screws 22, as best seen in FIG. 2, to the top of ram 15. The flaring of shaped apertures 29 and 30 may be other than spherical in shape to generate the needed annular space to loosely and pivotably retain flared end 24 at the top of ram 15.

As will be clear at this stage, loose retention of sleeve 19 at its flared end 24 by the top portion of ram 15, preferably with the introduction of suitable greaselike lubricant about the threads of power screw 17, will ensure that as the ram 15 traverses up and down between its uppermost and lowermost positions sleeve 19 will be guided by aperture 31 of cross rail 18 and be free to move and tilt somewhat about power screw 17. This ensures first, that no dirt or refuse from refuse drawer 12 can come into contact with the threaded portion of power screw 17 and, second, that during the successive traverses of ram 15 the lubricant will be both retained between sleeve 19 and power screw 17 and redistributed up and down its threaded portion.

Figure 5:
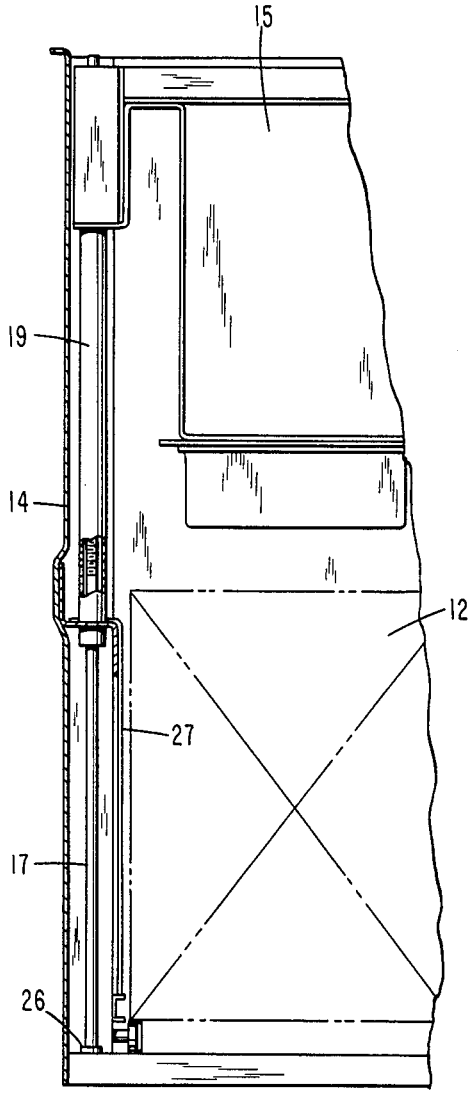
FIG. 5 is a partial front view showing the ram at its uppermost position, with a protective sleeve of this invention in place about one of the power screws.

As indicated in FIGS. 5 and 6, the lowest portions of power screws 17, particularly below cross rails 18, need not be provided with threads. Nevertheless, repeated traverses by ram 15 to compact refuse within drawer 12, as best seen in FIG. 5, will cause some dirt to adhere to the bottom of ram 15 and some of this may periodically pass over the edge of drawer 12 adjacent power screws 17. Some of the lubricant from the threaded portion is likely to adhere to the lower portion of power screws 17 and, occasionally, due to sticky materials this overflowing refuse may attach itself to power screw 17 and interfere with the downward free motion of sleeve 19. This could damage the sleeve and lead to obvious problems.

To insulate the lower portion of power screw 17 against such contamination by overflowing refuse, a thin flat sheet-like skirt 27 is attached at its top end to side bar 18 and at its lower end to frame 14 either by gluing, tabbing, or other appropriate means, as best seen in FIGS. 5 and 8.

Protective sleeve 19 is most suitably made from a strong and fairly stiff but flexible plastics material, e.g., dense polyethylene. Protective skirt 27, on the other hand, may be made of a relatively inexpensive material, such as fiberboard.

Figure 9:
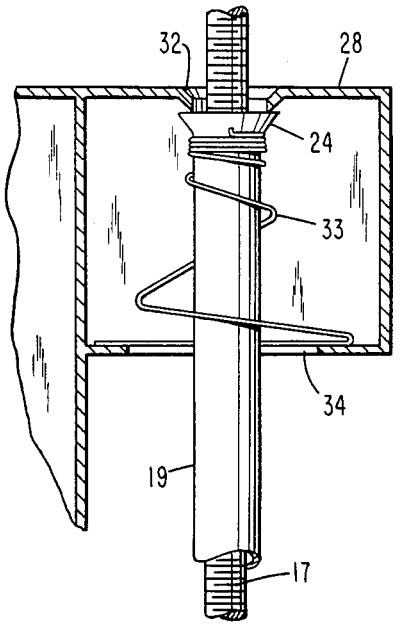
FIG. 9 is a partial vertical sectional view showing how the protective sleeve of this invention is supported loosely and pivotably at the ram in accordance with a second embodiment.

An alternative method of loosely retaining protective sleeve 19 to ram 15 is shown in FIG. 9. In this embodiment, aperture 32 in the top surface 28 of ram 15 has a flared shape with an internal diameter larger than that of power screw 17 but smaller than the diameter of the flared portion 24 at the top of sleeve 19. Furthermore, in order to hold flared portion 24 in loose contact with the flared portion of aperture 32 there is provided a helical conical spring 33 which is most conveniently inserted through a rather large aperture 34 provided therefor. Thus conical spring 33 is slipped around sleeve 19 so that the upper end of the spring holds flared end 24 of the sleeve, and the sleeve and spring together are slipped over power screw 17. Then, when ram 15 is lowered so that flared end 24 and the smaller diameter portion of conical spring 33 pass through large aperture 34, flared end 24 will be caught and retained at aperture 32 of ram 15 while the larger diameter spring of coiled spring 33 can be threaded in through large aperture 34 to seat upon the wall of aperture 34 in the ram surface 28 retained permanently thereat. As will be evident to persons skilled in the art, flared end 24 of protective sleeve 19 will be free to tilt about flared aperture 32 and will be loosely held thereat by the relatively soft spring 33. The operation of this embodiment is otherwise essentially the same as that previously described.

With the protective sleeve 19 and protective skirt 27, no matter how sleeve 19 is loosely and pivotally retained with respect to the top portion of ram 15, prolonged operation of the trash compactor is possible without any deleterious contamination of the lubricant by trash particles or the entanglement of any portions of the refuse from drawer 12 with the threads of power screw 17 or the lower portions thereof. The additional cost of two sleeves 19, two protective skirts 27, and possibly two helical conical springs 33 is a very small addition to the total cost of a typical trash compactor. Thus the invention disclosed herein, in any of its embodiments, will protect sensitive moving parts of a trash compactor and ensure sustained lubrication over long periods at relatively low cost.

It should be apparent from the preceding that the invention may be practiced otherwise than as specifically described and disclosed herein. Modifications may therefore be made to the specific embodiments disclosed herein without departing from the scope of this invention, and such variations are intended to be included within the claims appended below.

What is claimed is:

1. In a refuse compactor comprising a frame, a refuse drawer within the frame and a ram, screw means within the frame for movably supporting the ram alternatively in a first refuse compacting position within the drawer and a second position above the drawer, and drive means for driving said screw means to reciprocate said ram between said first and second positions:

a protective cover means surrounding said screw means, said cover means pivotably retained to and moving with said ram and extending at least to the drawer when said ram is in the second position.

2. The compactor of claim 1, wherein:

said frame includes a cross rail at one side of said drawer and beneath said ram for limiting downward movement of said ram, said cross rail having an aperture through which said screw means extends, said protective cover means extending from the ram into said aperture when the ram is in the first position.

3. The compactor of claim 2, wherein:

said cover means is a cylindrical sleeve extending through a circular aperture in said cross rail.

4. The compactor of claim 2, wherein:

said cover means is a cylindrical sleeve having an upper end that is outwardly flared, and said ram includes means for loosely retaining the flared end of said sleeve.

5. The compactor of claim 4, wherein:

said retaining means includes an extruded opening formed in the ram having a diameter that is intermediate between the diameter of the cylindrical sleeve and the larger diameter of the flared end of the sleeve; and a doubler plate on the ram having a second extruded opening in registration with and cooperating with the first opening to define an annular space for retaining the flared end of the sleeve.

6. The compactor of claim 4, wherein:

said retaining means includes spring means for resiliently biasing the flared end of said cylindrical sleeve into contact with said ram.

7. The compactor of claim 6, wherein:

said spring means is a helical spring having one end mounted to said ram and the other end retained against the flared end of said sleeve.

8. The compactor of claim 7, wherein:

said spring means is a conical helical spring threaded into an aperture formed in the ram beneath the flared end of said sleeve.

9. The compactor of claim 1, including:

a protective skirt mounted to said cross rail and extending downward beside said drawer.

10. A refuse compactor, comprising:

a frame, a region within the frame defining a refuse container;

a ram for compacting refuse;

screw means for supporting the ram alternatively between a first position to contact refuse in said container and a second position outside the container;

drive means coupled to said screw means for reciprocating said ram between said first and second positions;

a protective cylindrical sleeve covering at least a portion of said screw means above the refuse container; and means for pivotably retaining one end of said sleeve to said ram.

11. The compactor of claim 10, including:

a cross rail mounted on said frame at said refuse container;

said screw means passing through an aperture formed in said cross rail;

said sleeve extending from said ram into and slightly beyond said aperture when said ram is in said second position.

12. The compactor of claim 10, wherein:

said one end of said protective sleeve is flared; and said retaining means is contacting said flared end of said sleeve.

13. The compactor of claim 12, wherein:

said retaining means includes an extruded opening formed in the ram and having a diameter that is intermediate between the diameter of the cylindrical sleeve and the larger diameter of the flared end of the sleeve; and a doubler plate on the ram having a second extruded opening in registration with and cooperating with the first opening to define an annular space for retaining the flared end of the sleeve.

14. The compactor of claim 12, wherein:

said retaining means includes spring means for resiliently biasing the flared end of said cylindrical sleeve into contact with said ram.

15. The compactor of claim 10, including:

a protective skirt mounted to said frame and extending below said sleeve when said ram is in the second position.

16. A refuse compactor, comprising:

a frame, a region within the frame defining a refuse container;

a ram for compacting refuse;

screw means for supporting the ram alternatively between a lower position in contact with refuse in said container and an upper position outside said container;

drive means coupled to said screw means for reciprocating said ram between said upper and lower positions;

said frame including a cross rail for limiting the lowe position of the ram in the absence of refuse in said container;

said cross rail having an aperture through which said screw means passes;

a protective sleeve having an upper end retained to said ram and extending through the aperture of said cross rail to insulate from refuse only an upper portion of said screw means;

a protective skirt attached to said cross rail and extending downward to insulate a lower portion of said screw means from refuse.

17. The compactor of claim 16, including:

means for pivotably retaining said protective sleeve to said ram.

18. The compactor of claim 17, wherein:

the upper end of said protective sleeve is flared; and said retaining means includes means for retaining said flared end of said protective sleeve to said ram.

19. The compactor of claim 18, wherein:

said retaining means further includes a first extruded opening in said ram for receiving said sleeve, and a doubler plate on said ram above the flared end of said protective sleeve, the doubler plate having a second extruded opening in registration with said first extruded opening of said ram, the diameters of first and second extruded openings being less than the diameter of said flared end of said protective sleeve, the sleeve being thereby retained between said ram and said doubler plate.

20. The compactor of claim 18, wherein:

said first and second extruded openings are formed to different extrusion radii to enable the flared end of the protective sleeve to pivot in the radiused annular space between said ram and said doubler plate.

21. The compactor of claim 18, wherein:

said retaining means includes a helical spring for biasing the flared end of said protective sleeve against said ram.

22. The compactor of claim 21, including:

a support surface for one end of said spring, said support surface having an aperture, the spring being conical to be threaded into said aperture.

* * * * *